US011787625B2

(12) United States Patent
Francesco et al.

(10) Patent No.: US 11,787,625 B2
(45) Date of Patent: Oct. 17, 2023

(54) SPECIALTY INTERMODAL CONTAINER HAVING A ROLL COVER ROOF, METHOD OF USE AND MANUFACTURE

(71) Applicants: James Francesco, Ridgefield Park, NJ (US); William W. Gay, Ridgefield Park, NJ (US); Robert Berns, Ridgefield Park, NJ (US)

(72) Inventors: James Francesco, Ridgefield Park, NJ (US); William W. Gay, Ridgefield Park, NJ (US); Robert Berns, Ridgefield Park, NJ (US)

(73) Assignee: ARROWHEAD ENVIRONMENTAL PARTNERS, LLC, Ridgefield Park, NJ (US)

( * ) Notice: Subject to any disclaimer, the term of this patent is extended or adjusted under 35 U.S.C. 154(b) by 40 days.

(21) Appl. No.: 17/526,990

(22) Filed: Nov. 15, 2021

(65) Prior Publication Data

US 2022/0153513 A1 May 19, 2022

Related U.S. Application Data

(60) Provisional application No. 63/115,427, filed on Nov. 18, 2020.

(51) Int. Cl.

| | |
|---|---|
| ***B65D 88/12*** | (2006.01) |
| ***B65D 90/02*** | (2019.01) |
| ***B65D 90/54*** | (2006.01) |

(52) U.S. Cl.

CPC ..... *B65D 88/126* (2013.01); *B65D 88/127* (2013.01); *B65D 90/02* (2013.01);

(Continued)

(58) Field of Classification Search

CPC ..... B65D 1/48; B65D 88/126; B65D 88/127; B65D 88/125; B65D 88/005; B65D 88/02;

(Continued)

(56) References Cited

U.S. PATENT DOCUMENTS 3,796,342 A * 3/1974 Sanders ..... B65D 11/1826 220/6
4,130,208 A * 12/1978 Barry ..... B65G 63/025 414/334

(Continued)

*Primary Examiner* — Kareen K Thomas
(74) *Attorney, Agent, or Firm* — Baker Botts L.L.P.

(57) ABSTRACT

An intermodal container includes first and second ends, joined by first and second sides in a generally rectangular configuration. A generally continuous floor cooperates with the first and second ends and the first and second sides to form an open top container. A plurality of roof overhangs extend adjacent a top of the open top container, generally parallel to the floor. The intermodal container includes a roll cover having a first position in which the open top container is substantially open to the ambient environment to allow for loading from above the first and second sides and first and second ends of the open top container. The roll cover has a second position in which the open top container is substantially closed to the ambient environment to prevent any contents of the open top container to be ejected from the open top container during transport. A plurality of top reinforcement rails are disposed adjacent upper portions of the first and second sides, and extends from the first side to the second side.

19 Claims, 3 Drawing Sheets

(52) U.S. Cl.
CPC ..... *B65D 90/54* (2013.01); *B65D 2588/125* (2013.01); *B65D 2590/02* (2013.01); *B65D 2590/54* (2013.01)

(58) Field of Classification Search
CPC ..... B65D 88/06; B65D 88/10; B65D 88/121; B65D 88/122; B65D 88/123; B65D 88/124; B65D 77/14; B65D 85/66; B65D 88/546; B65D 90/02; B65D 90/54; B65D 2588/125; B65D 2590/02; B65D 2590/54
See application file for complete search history.

(56) References Cited

U.S. PATENT DOCUMENTS 4,577,772 A * 3/1986 Bigliardi ..... B65D 88/524 220/6
4,700,532 A * 10/1987 Redmond ..... B65B 11/50 53/457
4,875,814 A * 10/1989 Weller ..... B65D 90/006 410/121
5,735,482 A * 4/1998 Kuzik ..... B65D 85/66 242/537
6,697,589 B1 * 2/2004 Dunning ..... G03G 21/1685 399/122
2004/0007572 A1 * 1/2004 Payne ..... B65D 88/121 220/1.5
2008/0029510 A1 * 2/2008 Fisk ..... B65D 90/0026 220/7
2008/0105676 A1 * 5/2008 Park ..... B65D 88/121 220/1.5
2009/0038524 A1 * 2/2009 Linares ..... B63B 19/18 114/202
2010/0074723 A1 * 3/2010 Lancon ..... B65D 88/121 414/800
2010/0135742 A1 * 6/2010 Sain ..... B65D 88/129 410/46
2011/0239924 A1 * 10/2011 Walker ..... B63B 35/28 114/202
2018/0086186 A1 * 3/2018 Haag ..... B60P 1/28

* cited by examiner

SPECIALTY INTERMODAL CONTAINER HAVING A ROLL COVER ROOF, METHOD OF USE AND MANUFACTURE

CROSS-REFERENCE TO RELATED APPLICATION

This application claims the benefit of U.S. Provisional Patent Application No. 63/115,427 filed on Nov. 18, 2020, the disclosure of which is incorporated herein by reference in its entirety.

BACKGROUND

The costs associated with solid waste management have risen dramatically in recent years. The diminishing availability of landfill and other solid waste management facilities, governmental laws and regulations, and transporting debris over long distances are all factors driving the increase in costs. As those and the cost of labor have increased alternative methods for transporting solid waste from the customer sites at which the debris is handled (usually at a permitted transfer station) has increased the need for new methods for safely and efficiently handling waste transportation.

SUMMARY

In accordance with a particular embodiment of the present disclosure, an intermodal container includes first and second ends, joined by first and second sides in a generally rectangular configuration. A generally continuous floor cooperates with the first and second ends and the first and second sides to form an open top container. A plurality of roof overhangs extend adjacent a top of the open top container, generally parallel to the floor. The intermodal container includes a roll cover having a first position in which the open top container is substantially open to the ambient environment to allow for loading from above the first and second sides and first and second ends of the open top container. The roll cover has a second position in which the open top container is substantially closed to the ambient environment to prevent any contents of the open top container to be ejected from the open top container during transport. A plurality of top reinforcement rails are disposed adjacent upper portions of the first and second sides, and extend from the first side to the second side.

DETAILED DESCRIPTION

Figure 1:
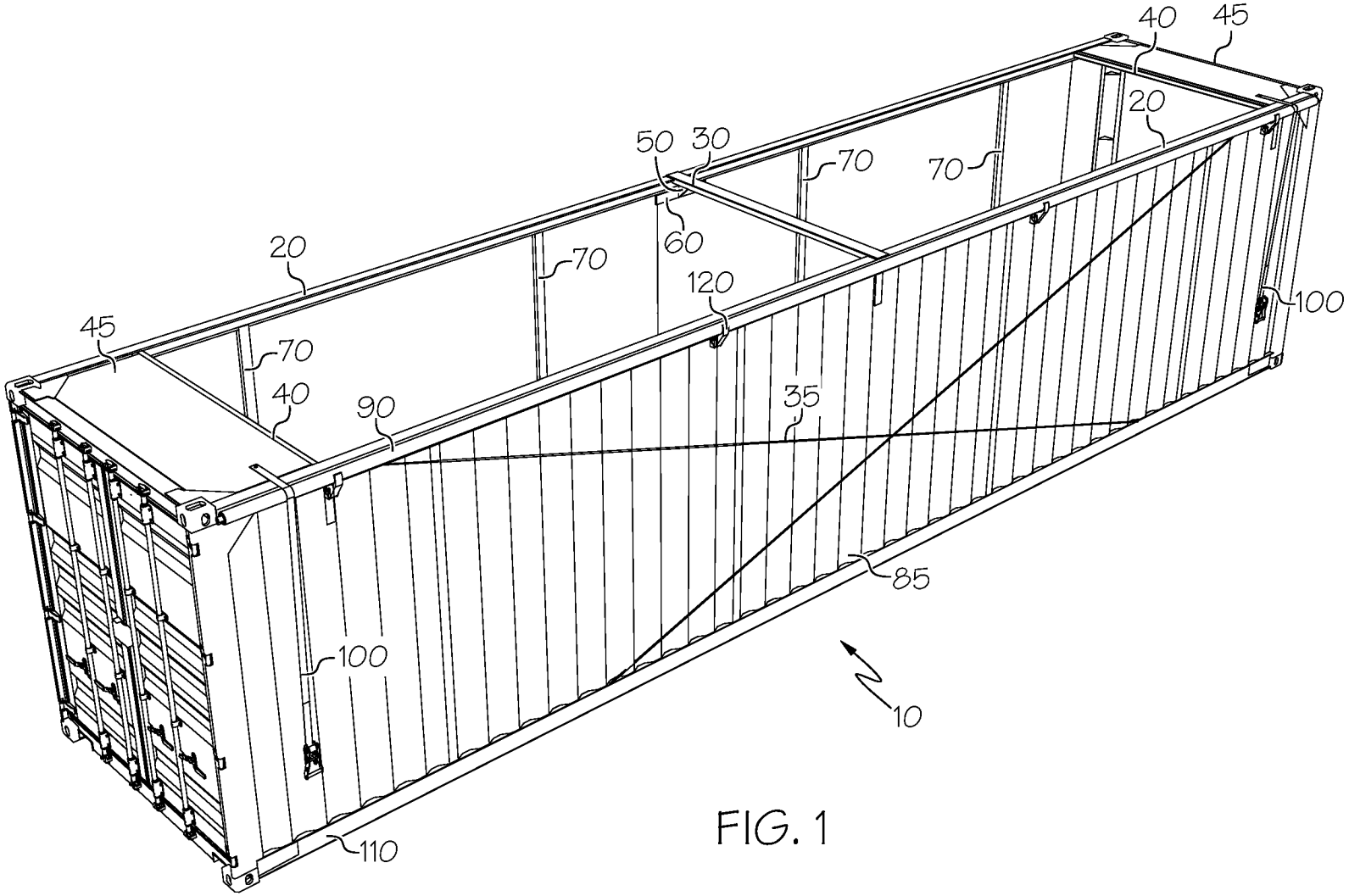
FIG. 1 illustrates an intermodal container, in accordance with a particular embodiment of the present disclosure.

Much of the nation's solid waste is transferred over the nation's roadways using trucks of various sizes. Trucks have the advantage of mobility and can be used to collect solid waste from practically any point at which it is generated. However, size limits, fuel costs and new limits on the hours drivers can sit behind the wheel have contributed to increased concerns about this method of transportation. In addition, trucks produce higher levels of greenhouse gases, relative to rail transportation, on a per-ton moved basis.

The nation's rail system has also been utilized to transport solid waste over large distances, since a much larger capacity is available and the cost of labor to transport a fixed amount of solid waste can be lower than using trucks. However, getting the solid waste to a nearby rail station can diminish the cost advantages. Also, the amount of labor necessary to collect, assemble, load and package solid waste (usually at a permitted solid waste transfer station) in the manner needed for traditional rail transportation methods is high.

One industry standard method involves using 20' long containers that are approximately 12' high with a solid metal lid. Such containers can carry approximately 60 to 62 cubic yards of solid waste per trip. However, specialized equipment is needed at the place of loading, in order to properly lid and seal the container and cover the load. Permits are often required if the lidding is to be done off-site from a permitted transfer station. Thus, such a system is difficult and can be at times prohibitively costly to employ at a customer's transfer station. In addition, to avoid highway height restrictions, these 12' high containers must move on expensive drop-deck chassis. The costs associated with transporting the solid waste in these containers makes for a less than ideal alternative.

The embodiments disclosed herein and in the attached figures provide methods that allow for municipal solid waste and debris to be loaded into containers a) as easy as it is currently to load a long-haul truck and b) in a container suitable for safe rail travel with waste inside. The containers have an open top design that allow for simple, fast and effective top loading into the containers. These containers also offer rooftop sealing covers that allow the containers to be transported over rail in compliance with federal, state and local laws, rules and regulations.

The rooftop sealing covers disclosed herein offer a fast and effective way to cover the containers in a manner that allow any customer or collection station to easily load and cover the containers without the need for any specialized equipment to handle the sealing cover.

In accordance with a particular embodiment disclosed herein, a standard 40' intermodal container (be they a closed-top or open-top version) can be modified in accordance with the teachings disclosed herein. For example, for a closed-top container, the roof can be removed from a standard 40' intermodal container to allow for top loading of solid waste. In particular embodiments, certain edges of the roof can remain in order to provide adequate strength and workability with the rest of the provided components. Top rails can be provided at various intervals in order to maintain the structural integrity of the container for loading and transportation purposes. C-channels can also be strategically placed at edges to provide additional strength and/or accommodate other equipment.

In accordance with a particular embodiment, a specially modified roll cover can be provided as the cover for the roof, after loading is complete. The specially modified roll cover may be installed across the 40' length of the container, from end to end. However, in order to enhance strength and provide for a stronger seal of the container, it may be advantageous in certain embodiments to provide the specially modified roll cover from side to side. Thus, a 40' specially modified roll cover can be installed across the top of the container from one side to the other in order to substantially decrease the length the specially modified roll cover will need to be extended to cover the load.

In order to provide for a user-friendly mechanism to close and seal the specially modified roll cover on the roof, low profile ratchets are strategically placed along the edges to tighten straps that are used to hold the specially modified roll cover down. These effectively close the specially modified roll cover roof sufficient for transportation and allows the end user to do this simply and effectively. Rope and bungy cords can also be used to more effectively seal the specially modified roll cover and keep the roof sealed during transportation. Once the customer or end user seals the container, it is not necessary to open the container until it reaches the final destination (e.g., landfill/disposal facility). The container design outlined in this submission allows for waste to be safely shipped on the rails, with little to zero odors being emitted or vermin attracted. This is a critical component to the safe and compliant shipment of waste on the nation's railroads.

Weep holes with plugs may also be employed in the floor and walls to allow for drainage (at the receiving landfill/disposal facility) due to fluid buildup that can accompany solid waste. At the same time the weep holes can be shut to prevent any leakage of fluids while the container is in transit to the landfill/disposal facility.

Another embodiment of the present disclosure is provided below and provides alternatives for components, sizes and placements, in accordance with a particular embodiment.

In accordance with the illustrated embodiment, a 40' standard intermodal container may be used with the roof removed (e.g., cut off with torch or other specialized equipment). However, persons of ordinary skill in the art will recognize that intermodal containers of practically any length (e.g., 20' to 53') may be used in accordance with the teachings of this disclosure. In particular embodiments, when the top of the container is removed, it may be desirable to leave a portion of the roof as an overhang at the front and rear of the container to provide stability for the covering system. The overhang may encompass the entire front and rear, or portions thereof. It may be a single portion or multiple portions at each of the front and rear. In some embodiments, an overhang or multiple overhangs may be used at the sides as well. Either the entirety of the sides, portions thereof, or multiple portions thereof each of the sides (or a single one of the sides). In a particular embodiment disclosed herein, an overhang of approximately 30" was used at the front and rear of the container. However, an overhang of between 12 inches and 36 inches may be employed within the teachings disclosed herein.

Figure 2:
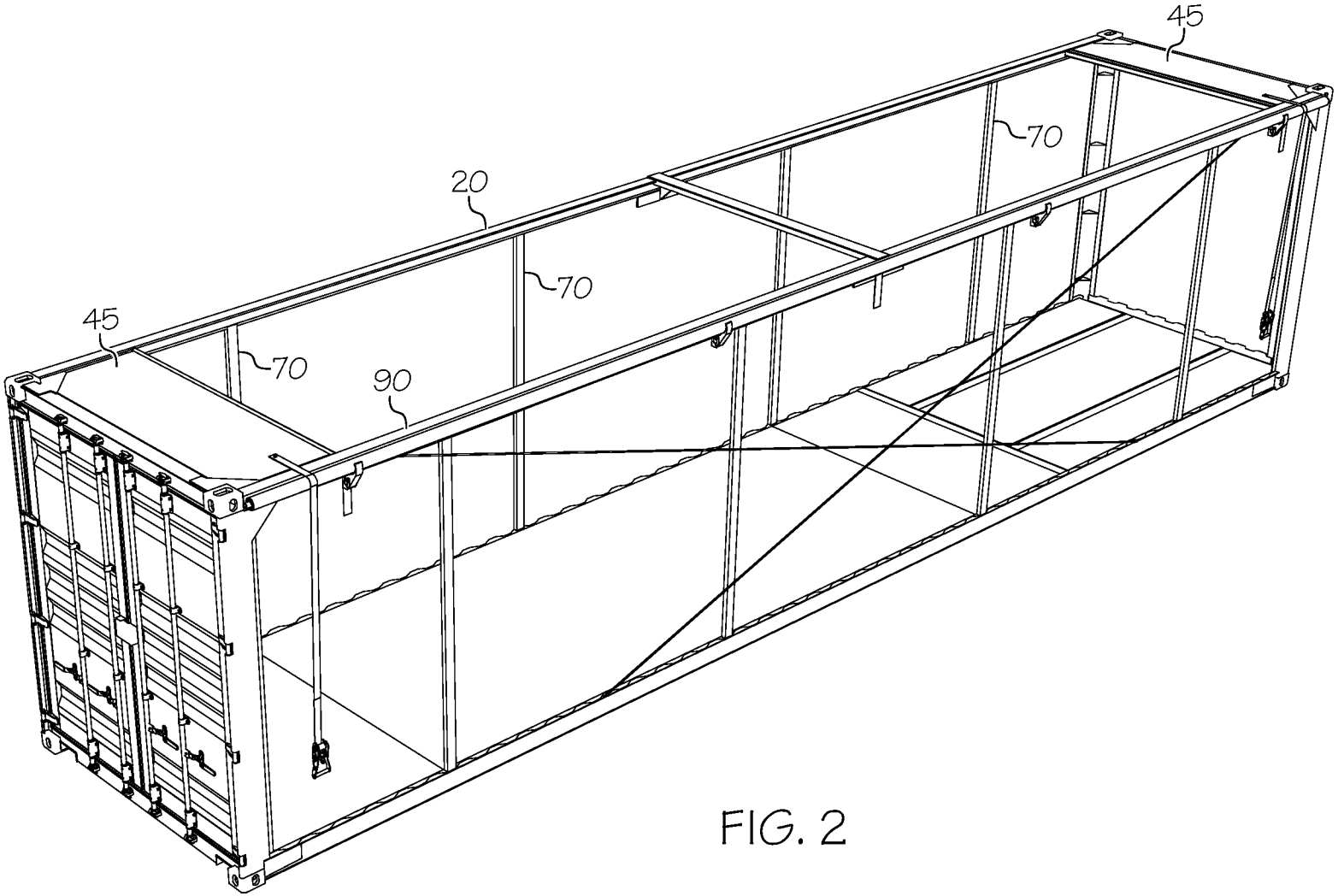
FIG. 2 illustrates the intermodal container of FIG. 1, with portions broken away for clarity.
Figure 3:
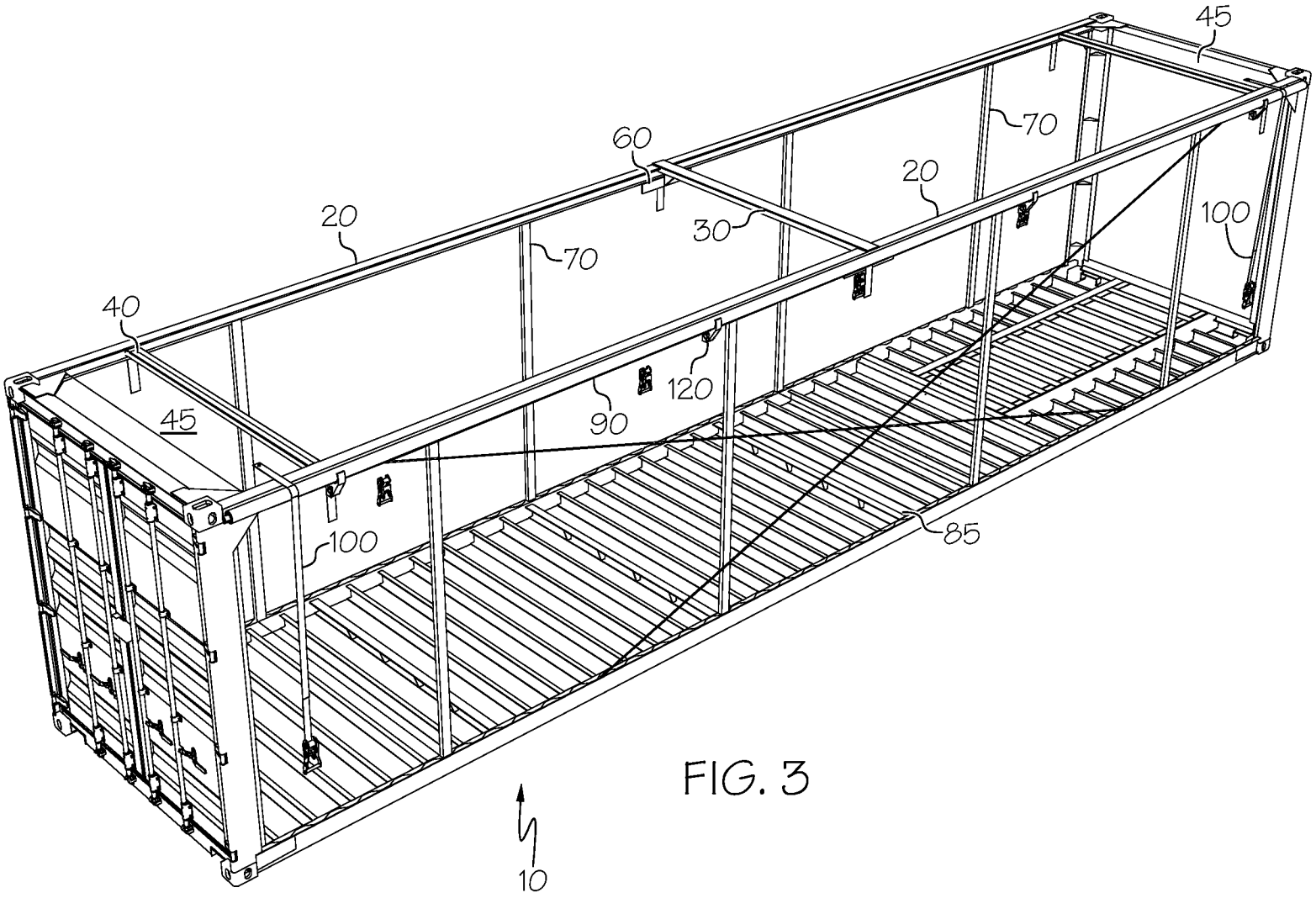
FIG. 3 illustrates the intermodal container of FIG. 1, with portions broken away for clarity.

In accordance with another embodiment of this disclosure, an open top container of approximately the dimensions of a standard 40' intermodal container (e.g., approximately 40'×8.5'×8') may be designed and built for these purposes. A particular embodiment of such a container is illustrated in the attached FIGS. 1-3. Certain components may be used to reinforce or otherwise improve the usability of such a container. For example, in a particular embodiment, components purchased from Metal USA may be used as follows [reference # to the attached figures are designated by brackets]:

[20] The top reinforcement may employ metal Angles 3"×4"×½"×39'8" (2 total pieces). These reinforcements may be placed on the top side rails of the container after the top is removed.

[30] A center cross member may be employed comprising metal Tube 6"×2"×⅜"×96" (1 total piece). This reinforcement may be placed at or near the middle of the container to maintain the rigidity of the side walls when the container is being loaded.

[40] Ends cross members may be employed comprising metal Tube 4"×2"×¼"×96" (2 total pieces). The cross members may be placed 30" from the front and rear of the container to provide wall stability. The 30" span comprises the "overhang" of the roof similar to that discussed above with regard to the modified container.

[50] Gussets may be employed comprising 6"×6"×8"×½" gussets (2 total pieces) and may be placed under the center crossmember to provide additional stability.

[60] Support plates may also be employed comprising 4"×22"×½" plates (2 total pieces and may be placed underneath gussets for additional stability.

[70] Interior Uprights C channel comprising 2"×1"×3/16"×91" ⅜ channels (8 total pieces) may be employed and placed vertically approximately every 5', four on each sidewall stitch welded into the sidewall, and tied into the top and bottom [85] rails.

[80] Rope Hooks may be employed comprising ¾"×3/16"×5" hooks (2 per container) and placed on the driver side, exterior, bottom rail of the container to hold ropes and/or bungee cords in place.

In particular embodiments, some or all of the hardware described below may be used as part of the modified container.

Bolts=⅜"–16×1" Grade 8 Yellow Zinc Finish Hex Cap Screw

Nuts=⅜"–16 Grade 8 Yellow Zinc Finish NE Steel Nylon Insert Lock Nut

Washers=⅜"×0.812" OD Thru-Hardened Yellow Zinc Finish Steel SAE General Purpose Flat Washer Steel Rope may be used to hold down the tarp comprising 1/16" (7×7) Break Strength 480 lbs Galvanized Cable Additionally, steel rope may be used to hold down the tarp comprising 3/16" (7×7) Break Strength 3700 lb Galvanized Cable Snap Link=5/16" 316 Stainless Steel Universal Spring Snap with Grommet may be placed in the center of the tarp in multiple locations (not shown, since tarp is rolled) in order to prevent the buildup of water or ice on the cover during transportation or storage.

Floor Screws=¼"-10×1½" Grade A Zinc Finish Hex Head Lag Screw may be used to provide drainage holes in the floor to avoid fluid buildup inside of the container.

Tarps screws=¼"-14×1" Hex—Unslotted Hex Washer Head Epoxy Finish #3 Point 410 Stainless Steel Self-Drilling Screw may be used to secure the tarp onto the 2" galvanized steel pipe.

Aluminum Sleeve=1/16" Aluminum Wire Rope Swage Sleeve

Aluminum Sleeves=3/16" Aluminum Wire Rope Swage Sleeve

Eye Bolt=⅜"-16×1" Shank Length×⅞" Thread Length×2½" OAL Zinc Finish Steel Turned Eye Bolt

[35] Rope may be used to hold the specially modified roll cover in place and seal the roof, comprising Solid Braided Nylon Rope—⅜"×500', Black×60' per container Bungees Cords may be used to hold the specially modified roll cover in place and seal the container comprising Rubber Tarp Straps—31" 10/pack×2 per container Floor drains may be used to remove fluid and prevent fluid from entering the containers, comprising:

2" Black iron floor flange=4 per container

2"×¼" Black iron Bushing=4 per container

Paint (Rustoleum) may be applied to the container according to the following:

High Performance Protective Enamel Gloss Smokey Grey Oil base exterior paint

High Performance Protective Enamel Gloss Safety Orange Oil base exterior paint

[90] Tarps (specially modified cover)=18 oz Heavy Duty PVC Coated Vinyl with 2" Polyester Seatbelt Webbing/6000 lb break strength sewn in it

[100] Side Straps=2" Polyester Seatbelt Webbing/6000 lb break strength with Heavy Wire D-Ring [110] sewn at one end and burned end×8' length. 5 per container on opposite side to that shown.

Securements Straps=2" Polyester Seatbelt Webbing/6000 lb break strength with Stainless Steel Grommet and burned end×11' length. 2 per container.

Ratchets=2" Low Profile Ratchet—1400 lbs break strength with modified ⅜ holes for mounting×7 per container.

Pipe Gudgeons=Cast Steel for ¾ inch Square Key×(1 per container) may be used to insert into the end of the 2" Galvanized pipe to lock/unlock pipe in place.

U Clamps=2" Plastic U-Clamps×5 per container are connected to the nylon straps that go into the ratchet and connects the strap to the pole.

Crank Handle=Kwik-Lock Straight Crank×96" may be used to insert into the end of the 2" galvanized steel pipe in order to rotate the pipe to roll/unroll the specially modified cover.

[130] Pipe=14 Gage 1" Galvanize Steel Pipe w/swaged end×40'×1 per container

Pipe=14 Gage 2" Galvanize Steel Pipe w/swaged end×40'×1 per container (tarp [90] is rolled around the 2" pipe to allow the tarp to be rolled/unrolled across roof.

[120] Tarp Stopper=Flexible 6" offset tarp stopper with Heavy duty mounting brackets w/steel pins×4 per container. The 1" galvanized pipe [130] is secured to the container inside of the tarp stoppers (4 locations) to hold the edge of the tarp in place while the 2" galvanized pipe is moved across the top of the container to cover the top of the container.

What is claimed is:

1. An intermodal container comprising:

first and second ends, joined by first and second sides in a generally rectangular configuration;

a generally continuous floor cooperating with the first and second ends and the first and second sides to form an open top container;

a plurality of roof overhangs extending adjacent a top of the open top container, generally parallel to the floor;

a roll cover having a first position in which the open top container is substantially open to the ambient environment to allow for loading from above the first and second sides and first and second ends of the open top container, and a second position in which the open top container is substantially closed to the ambient environment to prevent any contents of the open top container to be ejected from the open top container during transport; and a plurality of top reinforcement rails disposed adjacent upper portions of the first and second sides, and extending from the first side to the second side;

a center cross member extending from the first side to the second side; and wherein the cross member is located at an approximate midpoint between the first and second ends.

2. The intermodal container of claim 1, wherein the cross member is located at an approximate midpoint between the continuous floor and the roll cover, when the roll cover is in the second position.

3. An intermodal container comprising:

first and second ends, joined by first and second sides in a generally rectangular configuration;

a generally continuous floor cooperating with the first and second ends and the first and second sides to form an open top container;

a plurality of roof overhangs extending adjacent a top of the open top container, generally parallel to the floor;

a roll cover having a first position in which the open top container is substantially open to the ambient environment to allow for loading from above the first and second sides and first and second ends of the open top container, and a second position in which the open top container is substantially closed to the ambient environment to prevent any contents of the open top container to be ejected from the open top container during transport; and a plurality of top reinforcement rails disposed adjacent upper portions of the first and second sides, and extending from the first side to the second side;

a center cross member extending from the first side to the second side;

wherein the cross member is located at an approximate midpoint between the first and second ends;

first and second end cross members; and wherein the first end cross member is located between the first end and the midpoint between the first and second ends at a position closer to the first end than the midpoint between the first and second ends.

4. The intermodal container of claim 3, wherein the second end cross member is located between the second end and the midpoint between the first and second ends at a position closer to the second end than the midpoint between the first and second ends.

5. An intermodal container comprising:

first and second ends, joined by first and second sides in a generally rectangular configuration;

a generally continuous floor cooperating with the first and second ends and the first and second sides to form an open top container;

a plurality of roof overhangs extending adjacent a top of the open top container, generally parallel to the floor;

a roll cover having a first position in which the open top container is substantially open to the ambient environment to allow for loading from above the first and second sides and first and second ends of the open top container, and a second position in which the open top container is substantially closed to the ambient environment to prevent any contents of the open top container to be ejected from the open top container during transport; and a plurality of top reinforcement rails disposed adjacent upper portions of the first and second sides, and extending from the first side to the second side;

a center cross member extending from the first side to the second side;

wherein the cross member is located at an approximate midpoint between the first and second ends; and wherein the roll cover comprises a heavy duty PVC coated vinyl tarp extending from the first side to the second side, when the roll cover is in the second position.

6. The intermodal container of claim 1, wherein the roll cover comprises a heavy duty PVC coated vinyl tarp extending from the first end to the second end, when the roll cover is in the second position.

7. The intermodal container of claim 5, further comprising:

a steel pipe installed adjacent an upper portion of the first side and extending approximately from the first end to the second end; and wherein the vinyl tarp is wrapped around the steel pipe as the roll cover is moved from the second position to the first position.

8. The intermodal container of claim 6, further comprising:

a steel pipe installed adjacent an upper portion of the first end and extending approximately from the first side to the second side; and wherein the vinyl tarp is wrapped around the steel pipe as the roll cover is moved from the second position to the first position.

9. The intermodal container of claim 5, further comprising a crank handle couple with the steel pipe and configured to translate rotation of the crank handle to rotation of the steel pipe, in order to extend the vinyl tarp from the first position to the second position.

10. The intermodal container of claim 6, further comprising a crank handle couple with the steel pipe and configured to translate rotation of the crank handle to rotation of the steel pipe, in order to extend the vinyl tarp from the first position to the second position.

11. The intermodal container of claim 3, wherein the cross member is located at an approximate midpoint between the continuous floor and the roll cover, when the roll cover is in the second position.

12. The intermodal container of claim 5, wherein the cross member is located at an approximate midpoint between the continuous floor and the roll cover, when the roll cover is in the second position.

13. The intermodal container of claim 1, wherein the second end cross member is located between the second end and the midpoint between the first and second ends at a position closer to the second end than the midpoint between the first and second ends.

14. The intermodal container of claim 5, wherein the second end cross member is located between the second end and the midpoint between the first and second ends at a position closer to the second end than the midpoint between the first and second ends.

15. The intermodal container of claim 1, wherein the roll cover comprises a heavy duty PVC coated vinyl tarp extending from the first end to the second end, when the roll cover is in the second position.

16. The intermodal container of claim 3, wherein the roll cover comprises a heavy duty PVC coated vinyl tarp extending from the first end to the second end, when the roll cover is in the second position.

17. The intermodal container of claim 1, further comprising:

a steel pipe installed adjacent an upper portion of the first side and extending approximately from the first end to the second end; and wherein the vinyl tarp is wrapped around the steel pipe as the roll cover is moved from the second position to the first position.

18. The intermodal container of claim 3, further comprising:

a steel pipe installed adjacent an upper portion of the first side and extending approximately from the first end to the second end; and wherein the vinyl tarp is wrapped around the steel pipe as the roll cover is moved from the second position to the first position.

19. The intermodal container of claim 1, further comprising a crank handle couple with the steel pipe and configured to translate rotation of the crank handle to rotation of the steel pipe, in order to extend the vinyl tarp from the first position to the second position.

* * * * *